US008699899B2

(12) United States Patent
Murayama

(10) Patent No.: US 8,699,899 B2
(45) Date of Patent: Apr. 15, 2014

(54) IMAGE FORMING APPARATUS AND STORING MEDIUM FOR IMPROVING ACCURACY OF CORRECTION PROCESSING

(75) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 532 days.

(21) Appl. No.: 13/030,472

(22) Filed: Feb. 18, 2011

(65) Prior Publication Data

US 2011/0205560 A1 Aug. 25, 2011

(30) Foreign Application Priority Data

Feb. 25, 2010 (JP) ..... 2010-040659

(51) Int. Cl.
*G03G 15/00* (2006.01)

(52) U.S. Cl.
USPC ..... 399/49

(58) Field of Classification Search
USPC ..... 399/45, 49
See application file for complete search history.

(56) References Cited

U.S. PATENT DOCUMENTS

| | | | | |
|---|---|---|---|---|
| 7,697,876 | B2 * | 4/2010 | Nakatsu | 399/301 |
| 2005/0200689 | A1 | 9/2005 | Shinohara et al. | |
| 2007/0177912 | A1 | 8/2007 | Ikeda | |
| 2008/0118257 | A1 * | 5/2008 | Murakami | 399/49 |
| 2008/0292370 | A1 * | 11/2008 | Murayama | 399/301 |
| 2009/0162111 | A1 * | 6/2009 | Murayama | 399/301 |

FOREIGN PATENT DOCUMENTS

| | | | |
|---|---|---|---|
| JP | H08-248730 | A | 9/1996 |
| JP | 2000-259043 | A | 9/2000 |
| JP | 2002-214864 | A | 7/2002 |
| JP | 2002-215001 | A | 7/2002 |
| JP | 2002-351183 | A | 12/2002 |
| JP | 2003-084528 | A | 3/2003 |
| JP | 2003-207973 | A | 7/2003 |
| JP | 2005-241807 | A | 9/2005 |
| JP | 2005-266246 | A | 9/2005 |
| JP | 2005-352291 | A | 12/2005 |
| JP | 2006-276662 | A | 10/2006 |

(Continued)

OTHER PUBLICATIONS

Japan Patent Office, Decision of Patent Grant for Japanese Patent Application No. 2010-040659 (counterpart to above-captioned patent application), dispatched Apr. 3, 2012.

(Continued)

*Primary Examiner* — Walter L Lindsay, Jr.
*Assistant Examiner* — Philip Marcus T Fadul
(74) *Attorney, Agent, or Firm* — Baker Botts L.L.P.

(57) ABSTRACT

An image forming apparatus comprising: a formation unit; a control unit configured to control the formation unit to form a first batch and a second batch; a detection unit configured to detect detection values for marks in relation with position information of the respective marks in the first direction; a determination unit configured to determine whether each of the first and second batches are normal or abnormal based on the detection values; a modification unit configured to modify the detection value of a mark belonging to one of the first and second batches that has been determined to be abnormal by the determination unit, based on the detection value of a corresponding mark which belongs to an other of the first and second batches; and a correction unit configured to correct an image forming position of the formation unit based on the detection values modified by the modification unit.

20 Claims, 14 Drawing Sheets

(56) References Cited

FOREIGN PATENT DOCUMENTS

| | | | |
|---|---|---|---|
| JP | 2007-199620 | A | 8/2007 |
| JP | 2007-264364 | A | 10/2007 |
| JP | 2009-047719 | A | 3/2009 |

OTHER PUBLICATIONS

Japan Patent Office, Notification of Reason for Refusal for Japanese Patent Application No. 2010-040659 (counterpart to above-captioned patent application), dispatched Jan. 24, 2012.

* cited by examiner

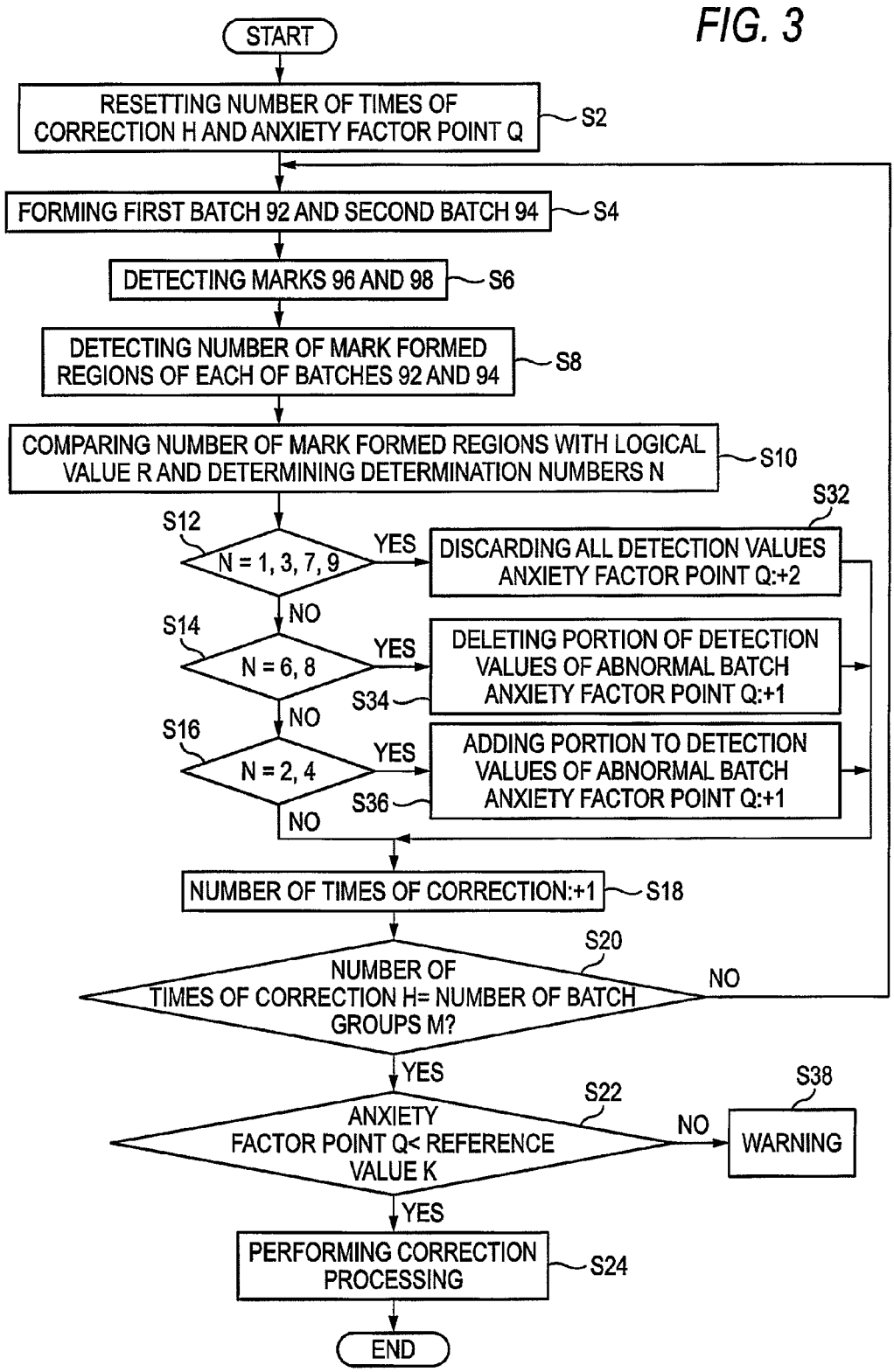
FIG. 3
START
RESETTING NUMBER OF TIMES OF CORRECTION H AND ANXIETY FACTOR POINT Q
S2
FORMING FIRST BATCH 92 AND SECOND BATCH 94
S4
DETECTING MARKS 96 AND 98
S6
DETECTING NUMBER OF MARK FORMED REGIONS OF EACH OF BATCHES 92 AND 94
S8
COMPARING NUMBER OF MARK FORMED REGIONS WITH LOGICAL VALUE R AND DETERMINING DETERMINATION NUMBERS N
S10
S12
N = 1, 3, 7, 9
YES
S32
DISCARDING ALL DETECTION VALUES ANXIETY FACTOR POINT Q:+2
NO
S14
N = 6, 8
YES
DELETING PORTION OF DETECTION VALUES OF ABNORMAL BATCH ANXIETY FACTOR POINT Q:+1
S34
NO
S16
N = 2, 4
YES
ADDING PORTION TO DETECTION VALUES OF ABNORMAL BATCH ANXIETY FACTOR POINT Q:+1
S36
NO
NUMBER OF TIMES OF CORRECTION:+1
S18
S20
NUMBER OF TIMES OF CORRECTION H= NUMBER OF BATCH GROUPS M?
NO
YES
S22
ANXIETY FACTOR POINT Q< REFERENCE VALUE K
NO
S38
WARNING
YES
PERFORMING CORRECTION PROCESSING
S24
END

FIG. 6A

| | DETECTION VALUE | IDENTIFIER | END PART POSITION | CENTRAL POSITION |
|---|---|---|---|---|
| | | A | 0 | |
| | 200 | B | 200 | 100 |
| | 500 | A | 700 | |
| | 200 | B | 900 | 800 |
| | 500 | A | 1400 | |
| | 200 | B | 1600 | 1500 |
| | 500 | A | 2100 | |
| | 200 | B | 2300 | 2200 |
| | 500 | A | 2800 | |
| | 200 | B | 3000 | 2900 |
| | 500 | A | 3500 | |
| | 200 | B | 3700 | 3600 |
| | 500 | A | 4200 | |
| | 200 | B | 4400 | 4300 |
| | 500 | A | 4900 | |
| | 200 | B | 5100 | 5000 |
| | | | | |
| | | | | |
| | | | | |
| | | | | |
| | | | | |
| | | | | |

FIG. 6B

| | DETECTION VALUE | IDENTIFIER | END PART POSITION | CENTRAL POSITION |
|---|---|---|---|---|
| | | A | 0 | |
| | 200 | B | 200 | 100 |
| | 220 | A | 420 | |
| | 60 | B | 480 | 450 |
| | 220 | A | 700 | |
| | 200 | B | 900 | 800 |
| | 500 | A | 1400 | |
| | 200 | B | 1600 | 1500 |
| | 500 | A | 2100 | |
| | 200 | B | 2300 | 2200 |
| | 500 | A | 2800 | |
| | 200 | B | 3000 | 2900 |
| | 500 | A | 3500 | |
| | 200 | B | 3700 | 3600 |
| | 500 | A | 4200 | |
| | 200 | B | 4400 | 4300 |
| | 500 | A | 4900 | |
| | 200 | B | 5100 | 5000 |
| | | | | |
| | | | | |
| | | | | |
| | | | | |

FIG. 6C

| | DETECTION VALUE | IDENTIFIER | END PART POSITION | CENTRAL POSITION |
|---|---|---|---|---|
| | | A | 0 | |
| | 200 | B | 200 | 100 |
| | 500 | A | 700 | |
| | 200 | B | 900 | 800 |
| | 500 | A | 1400 | |
| | 200 | B | 1600 | 1500 |
| | 500 | A | 2100 | |
| | 200 | B | 2300 | 2200 |
| | 500 | A | 2800 | |
| | 200 | B | 3000 | 2900 |
| | 500 | A | 3500 | |
| | 200 | B | 3700 | 3600 |
| | 500 | A | 4200 | |
| | 200 | B | 4400 | 4300 |
| | 500 | A | 4900 | |
| | 200 | B | 5100 | 5000 |
| | | | | |
| | | | | |
| | | | | |
| | | | | |
| | | | | |
| | | | | |

FIG. 7

| | | | | | | | | | | |
|---|---|---|---|---|---|---|---|---|---|---|
| NUMBER FOR FIRST BATCH | < | LOGICAL VALUE | & | NUMBER FOR SECOND BATCH | < | LOGICAL VALUE | → | N = 1 |
| NUMBER FOR FIRST BATCH | < | LOGICAL VALUE | & | NUMBER FOR SECOND BATCH | = | LOGICAL VALUE | → | N = 2 |
| NUMBER FOR FIRST BATCH | < | LOGICAL VALUE | & | NUMBER FOR SECOND BATCH | > | LOGICAL VALUE | → | N = 3 |
| NUMBER FOR FIRST BATCH | = | LOGICAL VALUE | & | NUMBER FOR SECOND BATCH | < | LOGICAL VALUE | → | N = 4 |
| NUMBER FOR FIRST BATCH | = | LOGICAL VALUE | & | NUMBER FOR SECOND BATCH | = | LOGICAL VALUE | → | N = 5 |
| NUMBER FOR FIRST BATCH | = | LOGICAL VALUE | & | NUMBER FOR SECOND BATCH | > | LOGICAL VALUE | → | N = 6 |
| NUMBER FOR FIRST BATCH | > | LOGICAL VALUE | & | NUMBER FOR SECOND BATCH | < | LOGICAL VALUE | → | N = 7 |
| NUMBER FOR FIRST BATCH | > | LOGICAL VALUE | & | NUMBER FOR SECOND BATCH | = | LOGICAL VALUE | → | N = 8 |
| NUMBER FOR FIRST BATCH | > | LOGICAL VALUE | & | NUMBER FOR SECOND BATCH | > | LOGICAL VALUE | → | N = 9 |

FIG. 9A

| | DETECTION VALUE | IDENTIFIER | END PART POSITION | CENTRAL POSITION |
|---|---|---|---|---|
| | | A | 0 | |
| | 200 | B | 200 | 100 |
| | 500 | A | 700 | |
| | 200 | B | 900 | 800 |
| | 500 | A | 1400 | |
| | 200 | B | 1600 | 1500 |
| | 500 | A | 2100 | |
| | 200 | B | 2300 | 2200 |
| | 500 | A | 2800 | |
| | 200 | B | 3000 | 2900 |
| | 500 | A | 3500 | |
| | 200 | B | 3700 | 3600 |
| | 500 | A | 4200 | |
| | 200 | B | 4400 | 4300 |
| | 500 | A | 4900 | |
| | 200 | B | 5100 | 5000 |
| | | | | |
| | | | | |
| | | | | |
| | | | | |
| | | | | |
| | | | | |

FIG. 9B

| | DETECTION VALUE | IDENTIFIER | END PART POSITION | CENTRAL POSITION |
|---|---|---|---|---|
| | | A | 0 | |
| | 200 | B | 200 | 100 |
| | | | | |
| | | | | |
| | 1200 | A | 1400 | |
| | 200 | B | 1600 | 1500 |
| | 500 | A | 2100 | |
| | 200 | B | 2300 | 2200 |
| | 500 | A | 2800 | |
| | 200 | B | 3000 | 2900 |
| | 500 | A | 3500 | |
| | 200 | B | 3700 | 3600 |
| | 500 | A | 4200 | |
| | 200 | B | 4400 | 4300 |
| | 500 | A | 4900 | |
| | 200 | B | 5100 | 5000 |
| | | | | |
| | | | | |
| | | | | |
| | | | | |
| | | | | |
| | | | | |

FIG. 9C

| | DETECTION VALUE | IDENTIFIER | END PART POSITION | CENTRAL POSITION |
|---|---|---|---|---|
| | | A | 0 | |
| | 200 | B | 200 | 100 |
| | 500 | A | 700 | |
| | 200 | B | 900 | 800 |
| | 500 | A | 1400 | |
| | 200 | B | 1600 | 1500 |
| | 500 | A | 2100 | |
| | 200 | B | 2300 | 2200 |
| | 500 | A | 2800 | |
| | 200 | B | 3000 | 2900 |
| | 500 | A | 3500 | |
| | 200 | B | 3700 | 3600 |
| | 500 | A | 4200 | |
| | 200 | B | 4400 | 4300 |
| | 500 | A | 4900 | |
| | 200 | B | 5100 | 5000 |
| | | | | |
| | | | | |
| | | | | |
| | | | | |
| | | | | |
| | | | | |

IMAGE FORMING APPARATUS AND STORING MEDIUM FOR IMPROVING ACCURACY OF CORRECTION PROCESSING

CROSS-REFERENCE TO RELATED APPLICATIONS

This application claims priority from Japanese Patent Application No. 2010-040659 filed on Feb. 25, 2010, the entire contents of which are incorporated herein by reference.

TECHNICAL FIELD

Aspects of the present invention relates to an image forming apparatus and a storing medium for storing an image forming program.

BACKGROUND

There has been proposed an image forming apparatus including a formation unit, which forms an image by the forming unit transferring an image on a relatively moving object. In such image forming apparatus, there is a case where position of an image formed by the formation unit on an object is deviated from an appointed position of the image, due to rotation irregularity of a photosensitive drum configuring the formation unit or movement irregularity of a convey belt for relatively moving the object and the formation unit. That is, a so-called positional deviation occurs. Related-art discloses a correction processing technique for preventing deterioration of image quality due to positional deviation. In the correction processing technique, a pair of batches disposed in a direction perpendicular to a movement direction of the convey belt are formed in plural sets. The positional deviation is suppressed by performing correction processing by using detection values obtained from the pair of batches.

SUMMARY

In the related-art correction processing, it is determined whether detection values obtained from each batch are normal. If the detection values obtained from one batch is determined to be abnormal, processing for invalidating not only the detection values obtained from the abnormal batch but also the detection values obtained from the other batch is performed. In this case, if the detection values obtained from the other batch are abnormal, even if the detection values obtained from one batch are normal, the correction processing cannot be performed by using the detection values obtained from the normal batch. Accordingly, the detection values that can be used for the correction processing are reduced, thereby lowering accuracy of the correction processing.

Accordingly, it is an aspect of the present invention to provide an image forming apparatus where the accuracy of the correction processing is improved.

According to an aspect of the present invention, there is provided an image forming apparatus comprising: a formation unit configured to form an image on a relatively moving object which moves in a first direction; a control unit configured to control the formation unit to form a first batch and a second batch which are disposed at different positions in a second direction perpendicular to the first direction, wherein the first batch includes a plurality of marks arranged in the first direction, and wherein the second batch includes a plurality of marks corresponding to each of the plurality of marks of the first batch, which are respectively arranged in a predetermined position relation in the first direction; a detection unit configured to detect detection values for the marks belonging to the first batch and the second batch, in relation with position information of the respective marks in the first direction; a determination unit configured to determine whether each of the first and second batches are normal or abnormal based on the detection values; a modification unit configured to modify the detection value of a mark belonging to one of the first and second batches that has been determined to be abnormal by the determination unit, based on the detection value of a corresponding mark which belongs to an other of the first and second batches; and a correction unit configured to correct an image forming position of the formation unit based on the detection values modified by the modification unit.

BRIEF DESCRIPTION OF DRAWINGS

FIG. 3 is a flow chart showing correction processing of the printer 10;

FIG. 6A is a table showing detection results of CPU 76;

FIG. 6B is a table showing detection results of the CPU 76;

FIG. 6C is a table showing detection results after modification;

FIG. 7 is a table for determination of batches 92 and 94;

FIG. 9A is a table showing detection results of the CPU 76;

FIG. 9B is a table showing detection results of the CPU 76;

FIG. 9C is a table showing detection results after modification; and

DETAILED DESCRIPTION

First Exemplary Embodiment

Hereinafter, the first exemplary embodiment of the present invention will be described with reference to FIGS. 1 to 9.

1. Overall Configuration of a Printer

Figure 1:
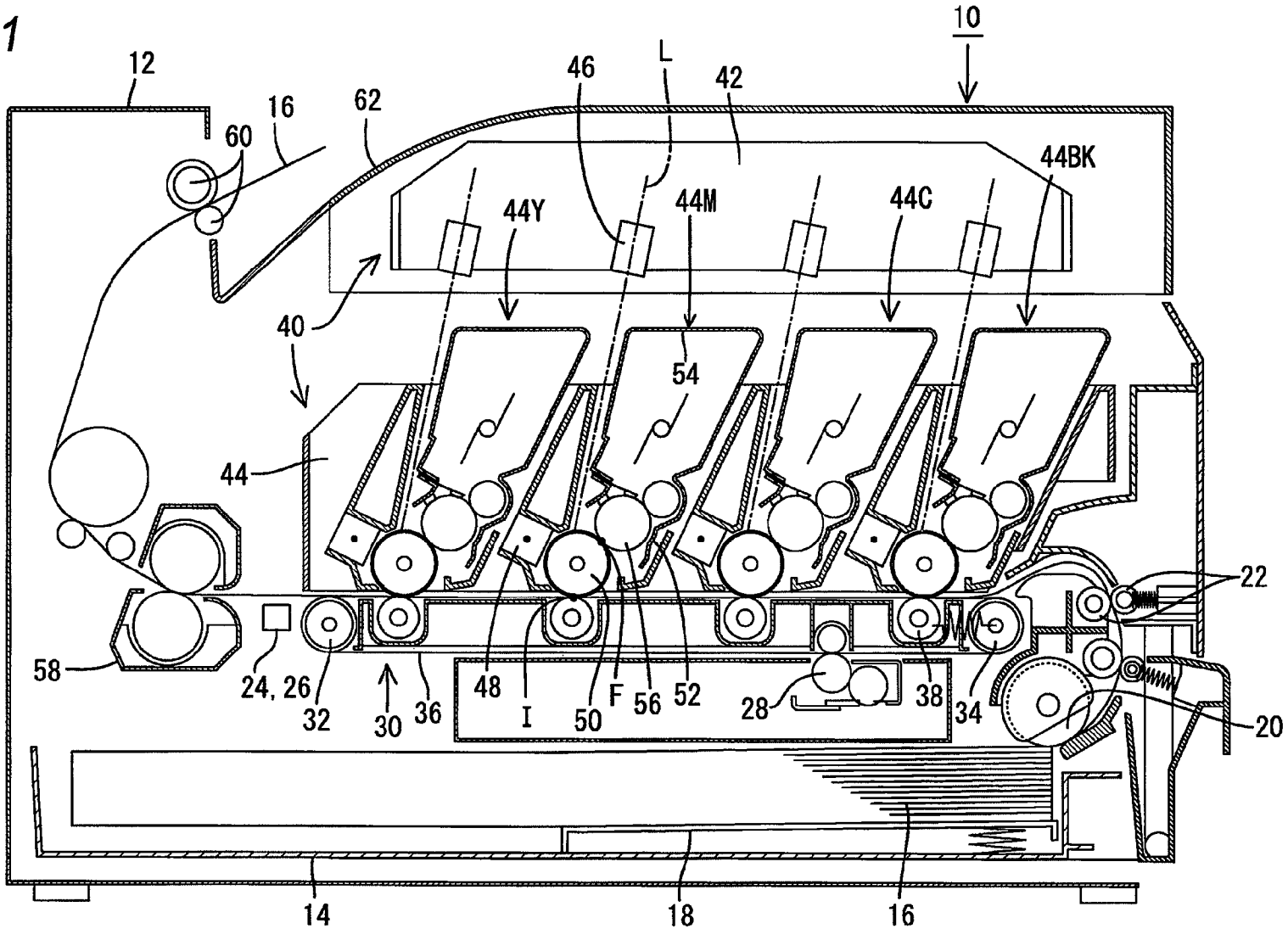
FIG. 1 is a side cross-sectional view of a printer 10.

As shown in FIG. 1, the printer 10 is a color laser printer using a direct transfer tandem method, which forms a color image by using toners of four colors (yellow, magenta, cyan, and black), and is configured inside a casing 12. A supply tray 14 is provided at a bottom portion in the casing 12. On the supply tray 14, a sheet material 16 such as a paper, is loaded.

When the sheet material 16 is supplied by a user to the supply tray 14 and is stored in the casing 12, it is lifted upwardly by a pressing plate 18 and is pressed by a pickup roller 20. The sheet material 16 is conveyed to a registration roller 22 by rotation of the pickup roller 20. Inclination correction of the sheet material 16 is performed by the registration roller 22, and then, the sheet material 16 is conveyed to a belt unit 30.

The belt unit 30 is configured by a pair of support rollers 32 and 34, a belt 36, and a plurality of transfer rollers 38. The belt 36 is looped around the support rollers 32 and 34, and both ends of the belt 36 are connected to form a ring shape. The transfer rollers 38 are arranged inside the ring shape of the belt 36 at equal intervals. The support rollers 32 and 34 are rotated in a counterclockwise direction by a motor, not illustrated, thereby moving the belt 36. The sheet material 16 conveyed to the belt unit 30 moves together with the belt 36, by the rotation of the belt 36.

An image formation unit 40 is provided on a top side of the belt unit 30. The image formation unit 40 is configured by scanner units 42 and process units 44. The scanner units 42 (process units 44) include four scanner units 42 (process units 44) corresponding to the four color toners. When specifying each of the scanner units 42 (process units 44), one or two alphabets (yellow: Y, magenta: M, cyan: C, and black: BK), which identify each of the four colors, will be used. The one or two alphabets are provided after reference numbers in the drawings. The process units 44 are arranged at equal intervals at positions corresponding to the transfer rollers 38 of the belt unit 30. Each of the scanner units 42 is disposed on an upper side of each of the corresponding process units 44.

The scanner units 42 control laser light emission units 46, respectively, based on respective color image data transmitted from a computer 70 (see FIG. 2), so as to irradiate laser light L on surfaces of photosensitive drums 50 provided in the corresponding process units 44.

Each of the process units 44 is configured by a charger 48, a photosensitive drum 50, a development cartridge 52, and others. The charger 48 uniformly positively charges a surface of the photosensitive drum 50. The development cartridge 52 includes a toner containing chamber 54, a development roller 56, etc. The toner containing chamber 54 of the development cartridge 52 is filled with toner, and the toner in the toner containing chamber 54 is supplied to the development roller 56.

When the image formation unit 40 forms an image on the sheet material 16 or the belt 36, the charger 48 positively charges the surface of the photosensitive drum 50. Next, laser light L is irradiated from the laser light emission unit 46 of the scanner unit 42 to the photosensitive drum 50. Accordingly, an electrostatic latent image corresponding to an image to be formed on the surface of the photosensitive drum 50 is formed.

When the photosensitive drum 50, on which the electrostatic latent image has been formed, passes a toner supply position F in relation to the development roller 56, the toner carried on the development roller 56 is supplied to the surface of the photosensitive drum 50 where the electrostatic latent image has been formed. Accordingly, a toner image in each color is formed on the photosensitive drum 50.

When the photosensitive drum 50, on which the toner image has been formed, passes a transfer position I in relation to the transfer roller 38, the toner image on the photosensitive drum 50 is transferred on the sheet material 16 (belt 36) passing the transfer position I by negative transfer bias applied to the transfer roller 38. As a result, an image is formed on the sheet material 16. In addition, batches 92 and 94 (see FIG. 4) are formed on the belt 36. Accompanying the movement of the belt 36, image of each color is consecutively formed on the sheet material 16 (belt 36). The image formed on the sheet material 16 is conveyed to a fuser 58 to be fixed, and is discharged by an exit roller 60 to an exit tray 62 provided outside the casing 12.

Figure 4:
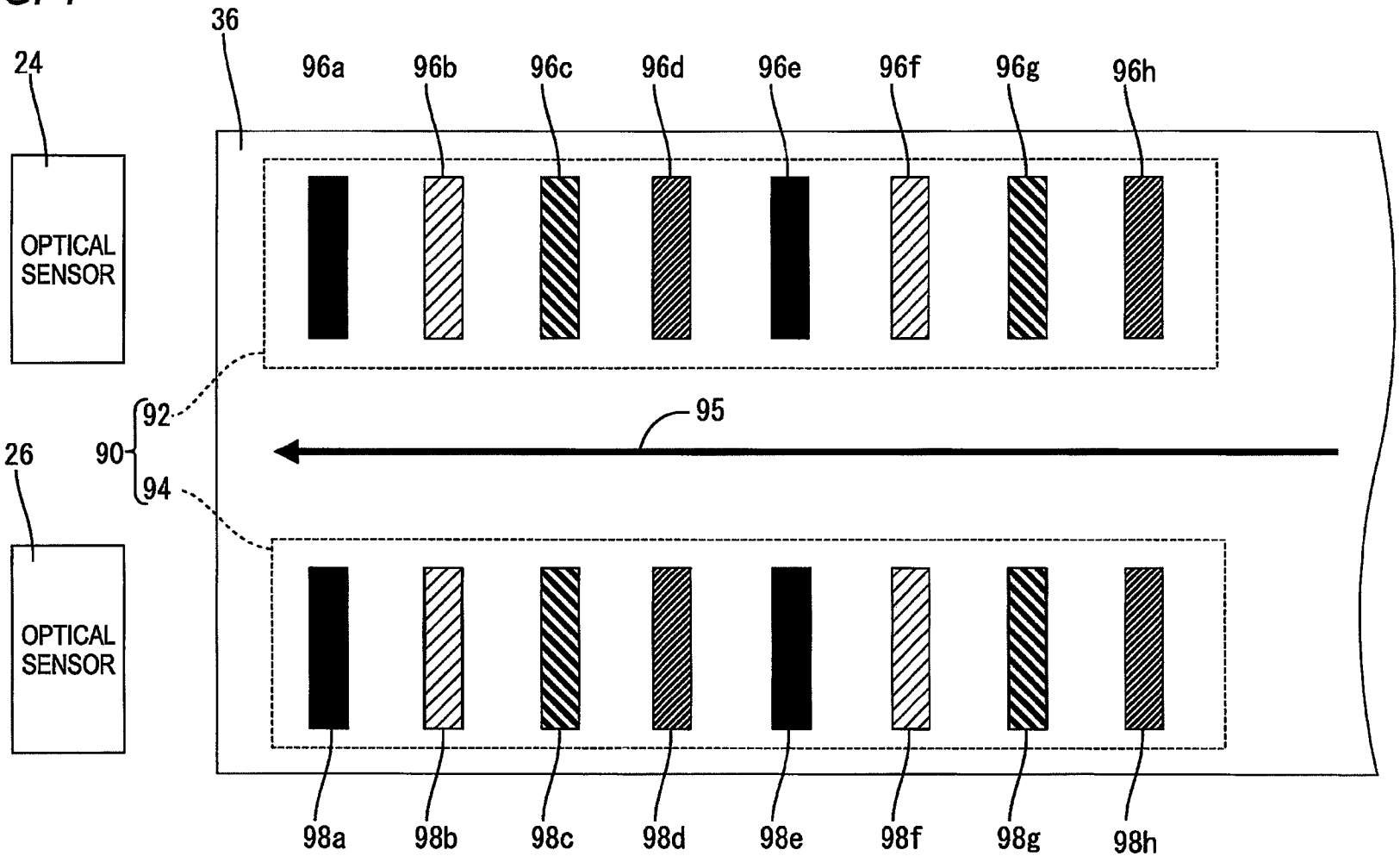
FIG. 4 is a top view of optical sensors 24 and 26 and a belt 36.

At a lower side of the belt unit 30, optical sensors (corresponding to detection units) 24 and 26 and a cleaning roller 28 are provided. The optical sensors 24 and 26 are configured to detect the batches 92 and 94 formed on the belt 36. The optical sensors 24 and 26 are reflective optical sensors. As shown in FIG. 4, the optical sensors 24 and 26 are arranged side by side in the direction perpendicular to the movement direction of the belt 36, (hereinafter, this direction may be referred to as the "left and right direction") presented by an arrow 95.

The cleaning roller 28 removes toner, paper dust, etc., attached on the belt 36. The "attached toner" includes the batches 92 and 94 intentionally formed on the belt 36, as well as toner unintentionally attached on the belt.

2. Electrical Configuration of the Printer

Figure 2:
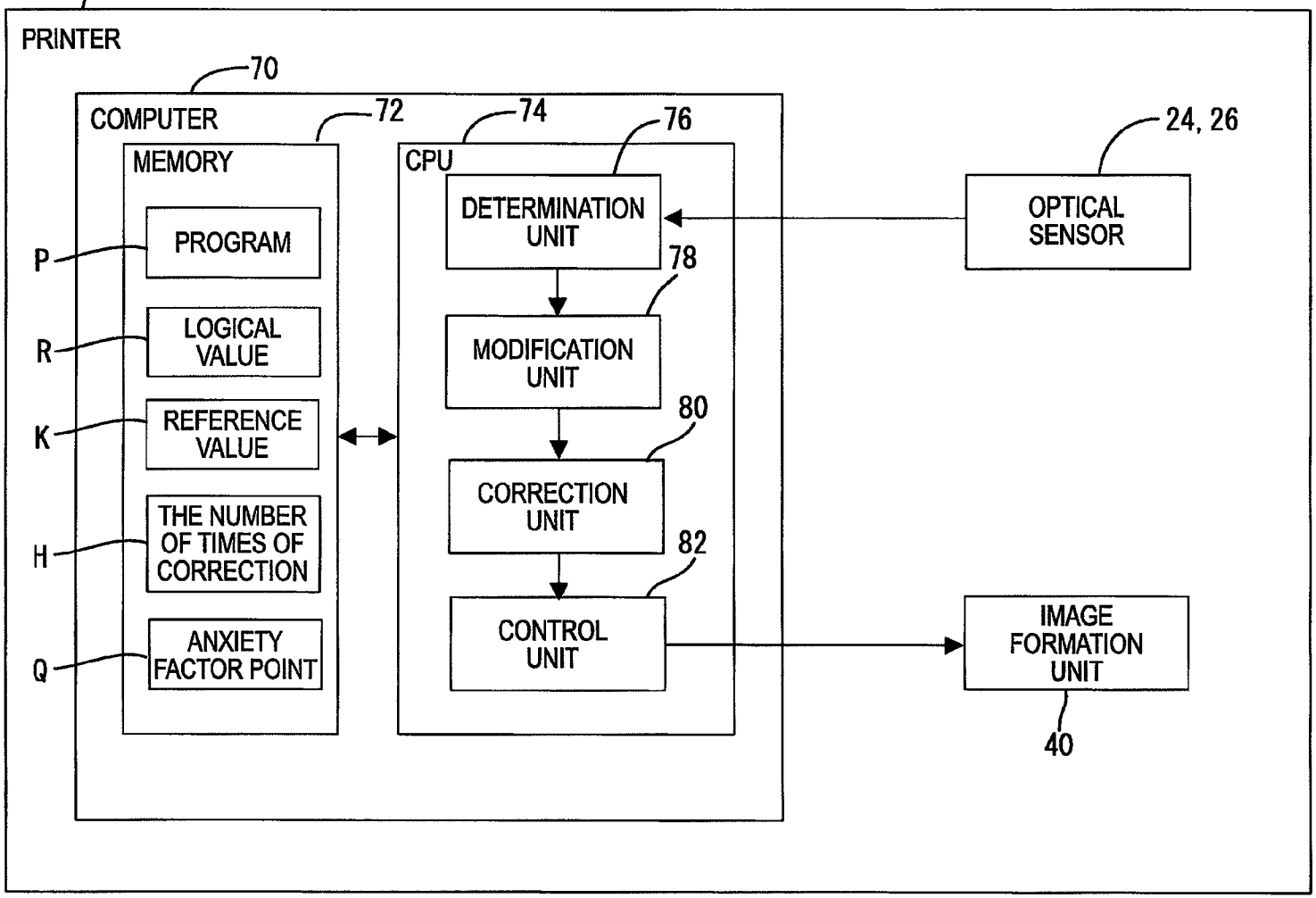
FIG. 2 is a block diagram showing a control system of the printer 10.

As shown in FIG. 2, the printer 10 is controlled by a computer 70 equipped in the printer 10. The computer 70 has a memory 72 and a Central Processing Unit (CPU) 74. The memory 72 stores various programs P for controlling operation of the printer 10. The CPU 74 realizes various functions of the printer 10, in accordance with the programs P read from the memory 72.

In the image formation unit 40 of the printer 10, four scanner units 42 (process units 44) corresponding to the toners in four colors is provided. If position of an image to be formed by each of the scanner units 42 (process units 44) on the sheet material 16 has not been adjusted, the quality of the image to be formed on the sheet material 16 becomes deteriorated. As such, the memory 72 of the computer 70 stores a program P for correcting the position of an image to be formed by each of the scanner units 42 (process units 44). Prior to forming an image on the sheet material 16, the printer 10 executes the program P. In this case, as shown in FIG. 2, the CPU 74 functions as a determination unit 76, a modification unit 78, a correction unit 80, and a control unit 82, and corrects the position of an image to be formed by each of the scanner units 42 (process units 44) by using a logical value R and a reference value K stored in the memory 72.

3. Correction Processing of a Formed Image

Correction processing of image forming position will be described with reference to FIG. 3. This processing is performed at a predetermined timing. The predetermined timing means when conditions for correction are met, such as when power is supplied to the printer 10, when the process units 44 or the development cartridge 52 are replaced, and when number of prints or elapsed time since previous correction processing exceeds a reference counter value.

Upon starting correction processing, the CPU 74 resets a number of times of correction H and an anxiety factor point Q, which are stored in the memory 72 (S2). Next, the CPU 74 functions as the control unit 82 to control the image formation unit 40 so as to form the first batch 92 and the second batch 94 on the belt 36 (S4). As shown in FIG. 4, the first batch 92 and the second batch 94 are arranged side by side in the left and right direction of the belt 36.

In the first batch 92, eight marks 96 in the same shape are arranged in line in the movement direction of the belt 36 showed by the arrow 95. In the second batch 94, eight marks 98 in the same shape are arranged in line in the movement direction of the belt 36. The marks 96 and 98 are arranged in the order of first marks 96*a* and 98*a*, second marks 96*b* and 98*b*, third marks 96*c* and 98*c*, fourth marks 96*d* and 98*d*, fifth marks 96*e* and 98*e*, sixth marks 96*f* and 98*f*, seventh marks 96*g* and 98*g* and eighth marks 96*h* and 98*h* along the movement direction of the belt 36, in which black marks, yellow marks, magenta marks, and cyan marks are arranged twice in this order. In the first batch 92 and the second batch 94, marks 96 and 98 in the same color are arranged in the same order and correspond to each other. The marks 96 and 98 are arranged in the same order at predetermined intervals in the movement direction of the belt 36. Corresponding marks 96 and 98 are disposed at an identical position in the movement direction of the belt 36. CPU 74 repeatedly forms M batch groups 90, each of which consists of the first batch 92 and the second batch 94, in the movement direction of the belt 36.

Next, the CPU 74 detects the marks 96 and 98 by using the optical sensors 24 and 26 (S6). As shown in FIG. 4, the optical sensor 24 is disposed at a position corresponding to the first batch 92 in the left and right direction of the belt 36 and detects the marks 96 formed on the first batch 92. The optical sensor 26 is disposed at a position corresponding to the second batch 94 in the left and right direction of the belt 36 and detects the marks 98 formed on the second batch 94.

The optical sensors 24 and 26 irradiate light from a light source equipped therein to the surface of the belt 36, and measures intensity of light reflected from the belt 36. The optical sensors 24 and 26 have a threshold S (see FIG. 5). If the measured reflected light intensity exceeds the threshold S, the optical sensors 24 and 26 determine that the marks 96 and 98 have been formed on the belt 36, and deliver the result to the CPU 74. The CPU 74 accesses a motor rotating the support rollers 32 and 34, and acquires position information in the movement direction of the belt 36 from the rotation quantity of the support rollers 32 and 34. The CPU 74 detects the determination result delivered from the optical sensors 24 and 26 in relation to the position information in the movement direction of the belt 36.

Figure 5:
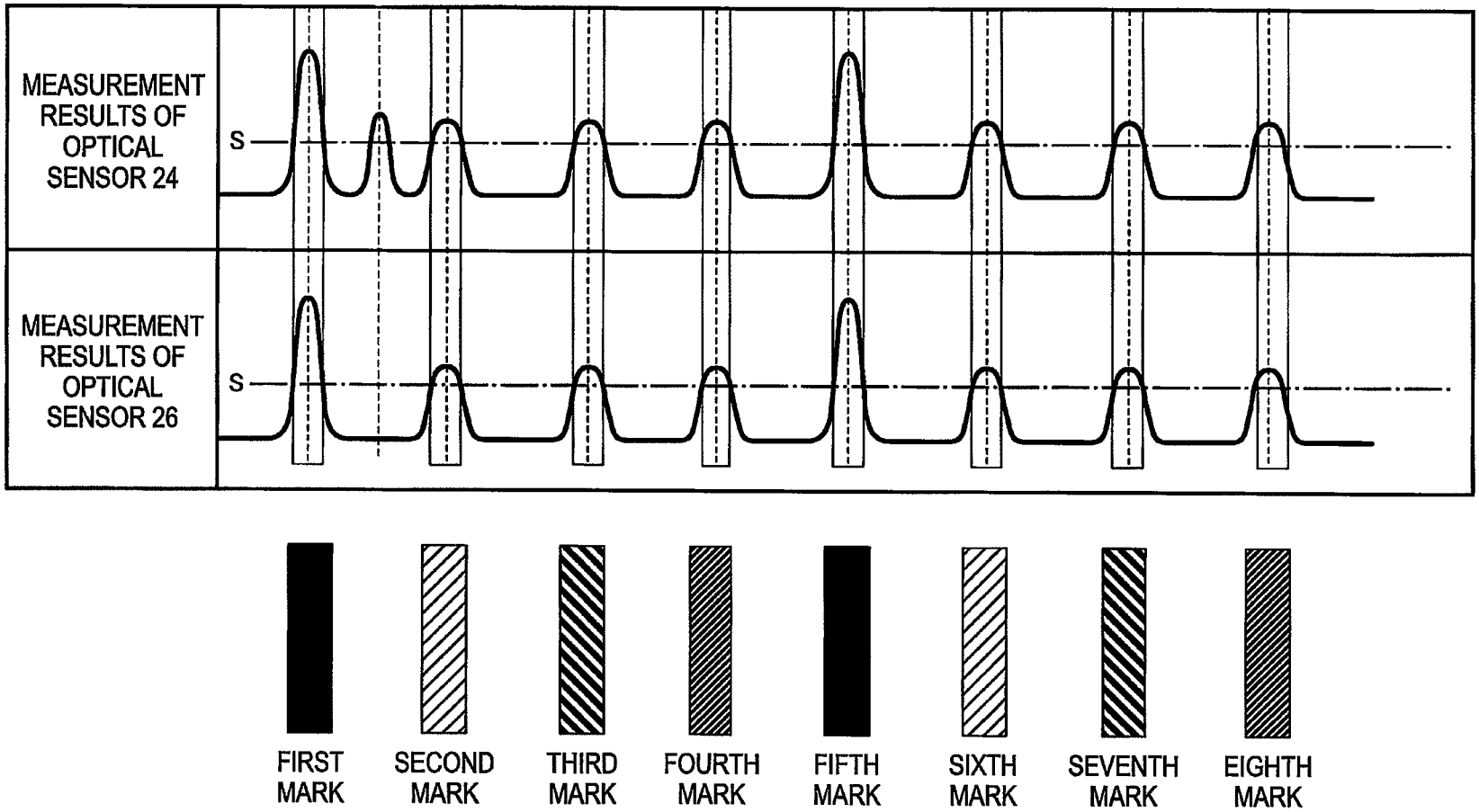
FIG. 5 is a graph showing measurement results of the optical sensors 24 and 26.

FIG. 5 shows the intensity of the reflected light of the belt 36 measured by the optical sensors 24 and 26. The horizontal axis represents positions in the movement direction of the belt 36, and marks formed on the positions are showed together. In the first exemplary embodiment 1, for better understanding, a detection start position of the first marks 96*a* and 98*a* is set as origin position in the movement direction of the belt 36.

As shown in FIG. 5, according to the measurement results of the optical sensor 26, the reflected light intensity at the position corresponding to the marks exceeds the threshold S, to be uplifted. The CPU 74 detects a width value of the region, in which the reflected light intensity exceeds the threshold S to be uplifted (mark formed region), and the region in which the reflected light intensity is not uplifted (mark non-formed region), in the movement direction of the belt 36, and counts "8" as the number of the mark formed regions. When the CPU 74 counts the number of the mark formed regions, the CPU 74 functions as a count unit (not shown). Meanwhile, according to the measurement results of the optical sensor 24, the reflected light intensity exceeds the threshold S to be uplifted in the region between a first mark and a second mark, other than the position corresponding to the marks 96. Therefore, the CPU 74 counts "9" as the number of the mark formed regions (S8).

FIG. 6A shows the detection results that the CPU 74 has detected by using the optical sensor 26. FIG. 6B shows the detection results that CPU 74 has detected by using the optical sensor 24. The first column represents a width value between the mark formed regions and the mark non-formed regions that the CPU 74 has detected. The second column represents identifiers. If the second column is "A," it means that the region is a mark non-formed region. If the second column is "B," it means that the region is a mark formed region. The third column represents position of an end part of each region in the movement direction of the belt 36. The fourth column represents a center position of the mark formed region. The value of the third column is calculated by summing values of the first column up to a corresponding line of the third column. The fourth column is calculated as an intermediate value between a position of the end part of the mark formed region and a position of the end part of the mark non-formed region in the previous line of the mark formed region.

Next, the CPU 74 functions as the determination unit 76 to compare the counted number of the mark formed regions and the logical value R. The CPU 74 stores the logical value "8" based on the number of the marks 96 and 98 formed on the respective batches 92 and 94. If the number of the mark formed regions is equal to the logical value R, the CPU 74 determines that the batch is normal. If the number of the mark formed regions is larger or smaller than the logical value R (see FIG. 6B), the CPU 74 determines that the batch is abnormal. A batch may be determined abnormal because, for example, the batch (marks belonging to the batch) has not been normally formed, or although the batch has been normally formed, detection values, which will be described later, are different from a predetermined value due to causes such as noises input into a detection unit. The CPU 74 determines a determination number N based on the determination table shown in FIG. 7 (S10).

If the determination number N is "1, 3, 7, or 9" (YES in S12), the CPU 74 determines that both the first batch 92 and the second batch 94 are abnormal. In this case, the CPU 74 is incapable of modifying the abnormal detection values by the normal detection values. The CPU 74 discards the detection values detected by using both the batches 92 and 94 and adds "2" to the anxiety factor point Q (S32).

Meanwhile, if the determination number N is "2, 4, 6, or 8," the CPU 74 determines that one batch is abnormal, and the other batch is normal. In this case, the CPU 74 functions as the modification unit 78 to modify the detection values of the batch determined to be abnormal by using the detection values of the batch determined to be normal. By modifying the detection values of the batch determined to be abnormal based on the detection values of the batch determined to be normal, the detection values of the batch that has been determined to be abnormal can be modified to be normal.

If the determination number N is "6 or 8" (NO in S12, and YES in S14), the CPU 74 determines that the number of the mark formed regions of one of the batches is larger than the logical value R. For example, as shown in FIG. 6B, if the number of the mark formed regions detected by using the first batch 92 is larger than the logical value R, the CPU 74 deletes a portion of the detection values of the marks 96 belonging to the first batch 92, by using the detection values of the marks 98 belonging to the second batch 94 that has been determined to be normal as shown in FIG. 6B, and adds "1" to the anxiety factor point Q (S34).

The CPU 74 compares the central position of the mark formed region (fourth column) of FIG. 6B with the end part position (third column) of FIG. 6A. Since the central position "450" of FIG. 6B exists in the mark non-formed region "200 to 700" between the first mark and the second mark in FIG. 6A, the CPU 74 determines that this detection value is abnormal. The CPU 74 adds up, among the detection values (first column) of FIG. 6B, a width value of the mark formed region in which the central position is "450", and width values of the mark non-formed regions which exist prior to and after the mark formed region, to obtain a width value of a new mark non-formed region (refer to FIG. 6C).

Figure 8:
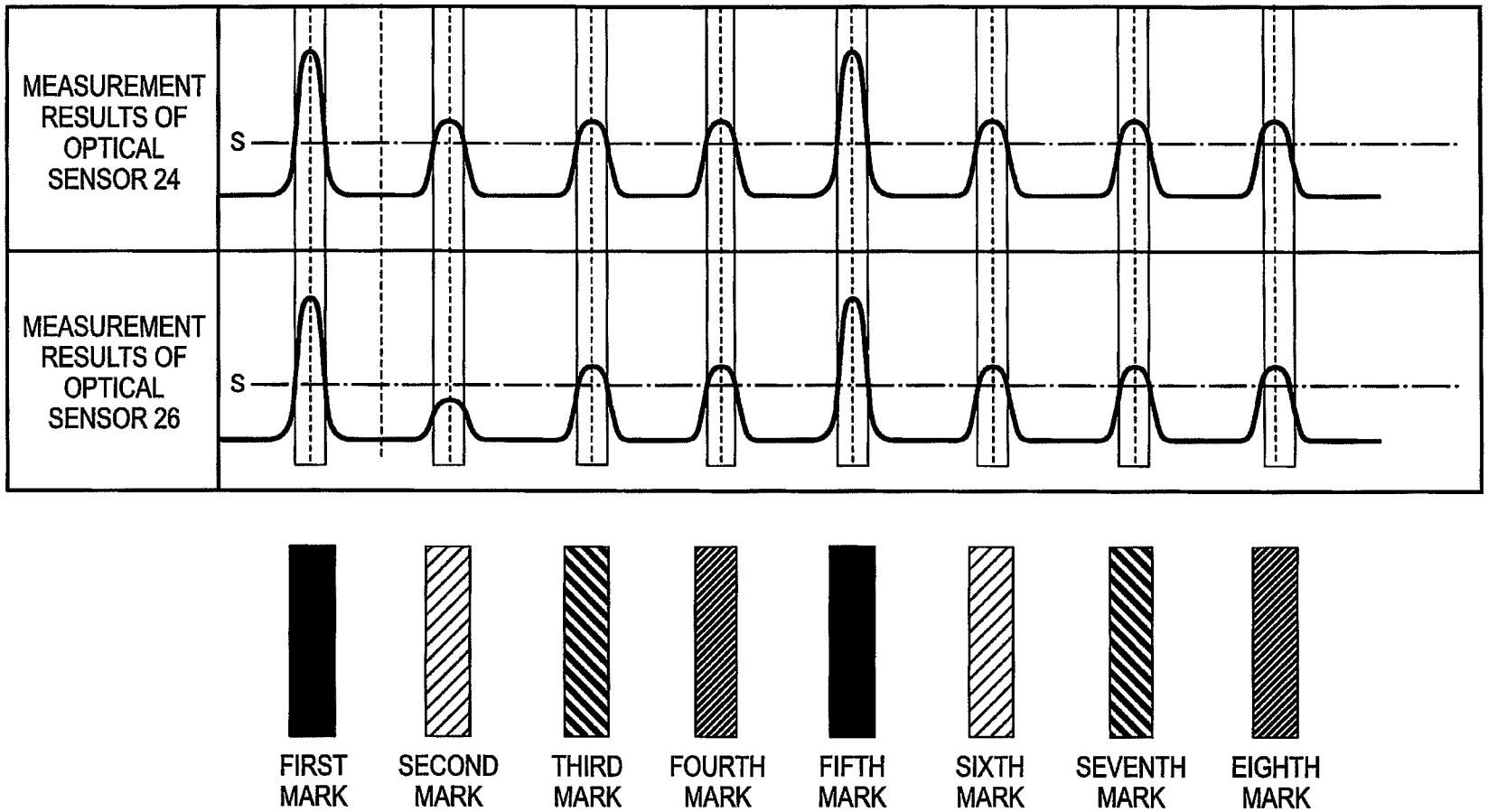
FIG. 8 is graph showing measurement results of the optical sensors 24 and 26.

Meanwhile, if the determination number N is "2 or 4" (NO in S12 and S14 and YES in S16), the CPU 74 determines that the number of the mark formed regions in one of the batches is smaller than the logical value R. An example of this case is shown in FIG. 8, where the second batch 94 is normal, but the reflected light intensity corresponding to the second mark 96*b* of the marks 96 of the first batch observed by the optical sensor 24 does not exceed the threshold S to be uplifted, and the CPU 74 counts "7" as the number of the mark formed regions. If the number of the mark formed regions detected by using the first batch 92 is smaller than the logical value R, the CPU 74 adds a portion to the detection values of the marks 96 of the first batch 92, by using the detection values of the marks 98 of the second batch 94 that has been determined to be normal, and adds "1" to the anxiety factor point Q (S36).

FIG. 9A shows the detection results that the CPU 74 has detected by using the optical sensor 26. FIG. 9B shows the detection results that CPU 74 has detected by using the optical sensor 24. The CPU 74 compares the central position of the mark formed region (fourth column) of FIG. 9B and the end part position (third column) of FIG. 9A. Due to absence of the central unit of the mark formed region of FIG. 9B that should exist within the mark formed region "700 to 900" of FIG. 9A, the CPU 74 determines that the first batch 92 is abnormal. The CPU 74 adds, the width value "500" of the mark non-formed region between the first mark 96*a* and the second mark 96*b* in FIG. 9A and the width value "200" of the second mark 96*b*, to the detection values (first column) of FIG. 9B. The CPU 74 subtracts "500" and "200" from the detected value "1200" to obtain the width value of the mark non-formed region between the first mark 96*a* and the second mark 96*b* (see FIG. 9C).

If the determination number N is "5" (NO in S12, S14, and S16), the CPU 74 determines that both the first batch 92 and the second batch 94 are normal. In this case, the CPU 74 does not need to modify abnormal detection values. The CPU 74 does not perform modification processing and maintains the anxiety factor point Q.

If each of S32, S34, and S36 is performed, or if answers in S12, S14, and S16 are all NO, the CPU 74 adds "1" to the number of times of correction H (S18). The CPU 74 performs the processing for each of M batch groups formed on the belt 36 (S20).

Next, the CPU 74 compares the anxiety factor point Q with the reference value K. If the anxiety factor point Q is equal to or higher than the reference value K (NO in S22), the CPU 74 executes warning by notification, display, etc. (S38). In this case, a problem which cannot be resolved by correction by the computer 70, such as the case where the belt 36 is too deteriorated so that the batches 92 and 94 cannot be formed normally, or the case where formation of certain marks 96 and 98 included in the batches 92 and 94 has been repeatedly failed, may have occurred. By informing a user of the problems through warning by the CPU 74, it is possible to urge the user to deal with the problems.

If the anxiety factor point Q is smaller than the reference value K (YES in S22), the CPU 74 functions as the correction unit 80 to perform the correction processing (S24). The CPU 74 compares the position information of the detection values of the marks 96 and 98 included in the batches 92 and 94, respectively, with a design value, to correct positional deviation of each of the scanner units 42 (process units 44).

In this embodiment, if one of the first batch 92 and the second batch 94 has been determined to be abnormal, it is possible to modify the detection values obtained from the abnormal batch by using the detection values obtained from the other batch, and correct the image formation position of the image formation unit 40 by using the modified detection values. Thus, even if one of the batches has been determined to be abnormal, it is possible to perform correction processing by using the detection values obtained from the other batch. Therefore, the number of the detection values that can be used for the correction processing increase, and accuracy of the correction processing of the image formation unit 40 can be improved.

Second Exemplary Embodiment

Hereinafter, the second exemplary embodiment of the present invention will be described with reference to FIG. 10.

In a printer 100 of the second exemplary embodiment, marks 196 formed on a first batch 192 and marks 198 formed on a second batch 194 are arranged in the same order at equal intervals in the movement direction of the belt 36. However, the printer 100 is different from the printer 10 of the first exemplary embodiment in that corresponding marks 196 and 198 are disposed at different positions in the movement direction of the belt 36.

Figure 10:
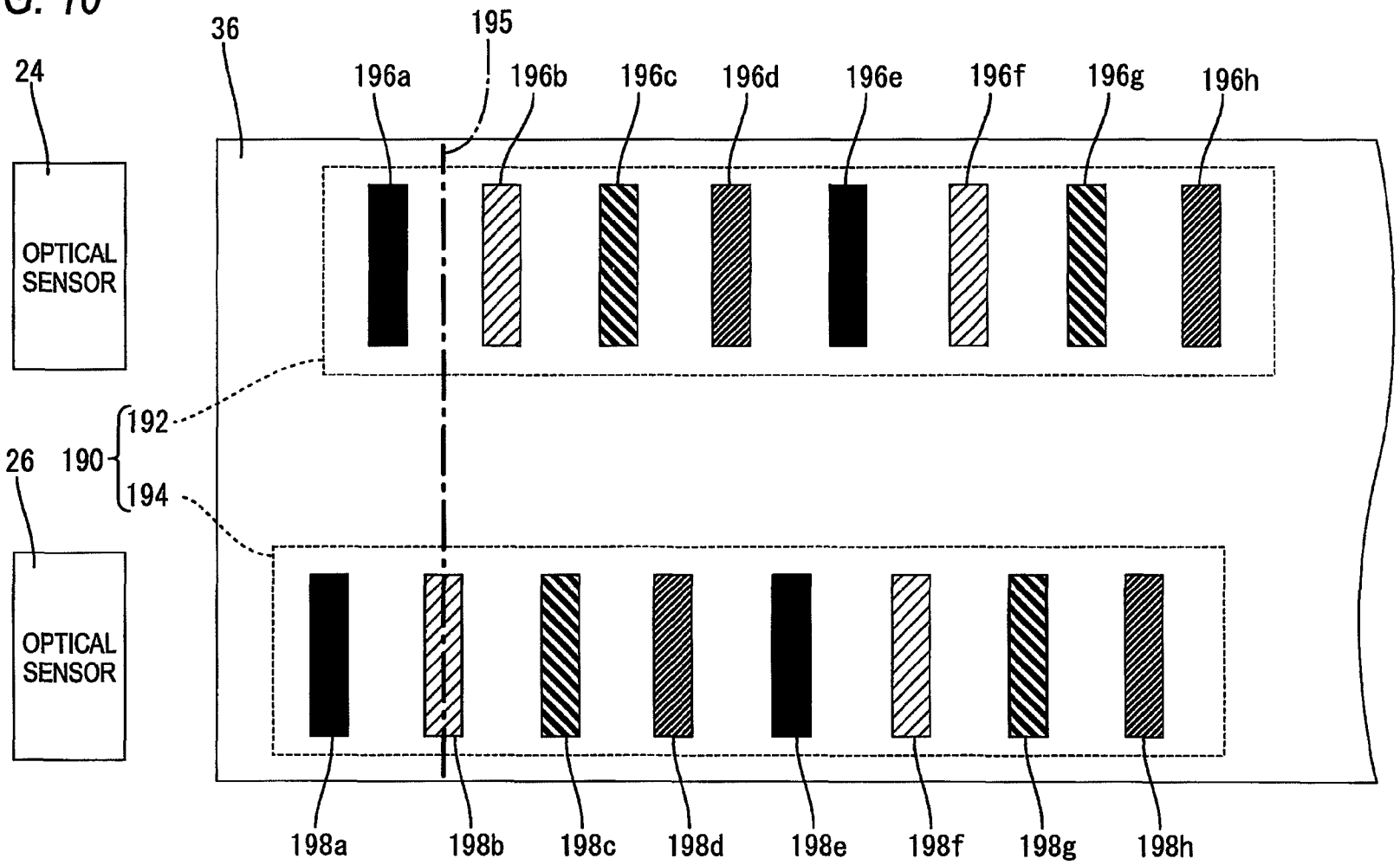
FIG. 10 is a top view of the optical sensors 24 and 26 and the belt 36.

In the printer 100, as shown in FIG. 10, scratch 195 extending in the left and right direction of the belt 36 may be formed on the surface of the belt 36. If scratch is formed on the marks 196 and 198 included in the batches 192 and 194, the batches 192 and 194 are determined to be abnormal. If corresponding marks in the first batch 192 and the second batch 194 are disposed at an identical position in the movement direction of the belt 36, both the first batch 192 and the second batch 194 are determined to be abnormal due to the scratch 195, so that data detected from the batch group 190 should be discarded. As a result, detection values that can be used for correction processing are reduced, and accuracy of correction cannot be improved. If corresponding marks in the first batch 192 and the second batch 194 are disposed at different positions in the movement direction of the belt 36, both of the corresponding marks 196 and 198 being scratched will be prevented. Even if the marks belonging to one of the batches are scratched, it is possible to modify detection values of the marks belonging to the scratched batch based on the detection values of the marks belonging to the other batch. Therefore, the detection values that can be used for the correction processing increase, and the accuracy of the correction can be improved.

Meanwhile, if the corresponding marks in the first batch 192 and the second batch 194 are disposed at different positions in the movement direction of the belt 36, the modification processing performed by the CPU 74 generally becomes complicated compared to the case where the marks are disposed at identical positions in the movement direction of the belt 36. Among the detection values of the marks 196 belonging to the first batch 192 and the detection values of the marks 198 belonging to the second batch 194, if at least one group of corresponding marks has been detected, it is preferred that the CPU 74 predict positions of other marks based on the position information of the corresponding marks. As shown in FIG. 10, if the marks 196 belonging to the first batch 192 and the marks 198 belonging to the second batch 194 are formed in the same order at equal intervals in the movement direction of the belt 36, the positional difference between the corresponding marks in the movement direction of the belt 36 is constant. Therefore, by using this information, specifying the detection values corresponding to each of the marks 196 and 198 can be easily performed.

The present invention is not limited to the embodiments that have been described above and in the drawings. The technical scope of the present invention includes, for example, the embodiments set forth below.

For example, the image forming apparatus is not limited to a color printer, and may be, for example, a monochrome printer, or a so-called multifunctional machine having copying function.

Corresponding marks of the first batch and the second batch may not be formed in the same order at equal intervals. However, if corresponding marks are formed in different orders or at different intervals, it will be necessary to predetermine position relation such as relative or absolute position information of the corresponding marks. In the present invention, based on the position relation, detection values between corresponding marks are compared, and modification processing is performed, so that the correction accuracy in the correction processing can be improved.

In the above-described exemplary embodiments, in the correction processing for correcting the deviation of image forming position in the movement direction of the belt 36 by forming marks 96 and 98 lengthening in the left and right direction of the belt 36, the detection values of one of the batches that has been determined to be abnormal are modified by using the detection values obtained from the other batch. However, the present invention is not limited to this configuration. For example, the present invention includes a case in which marks different from those in the exemplary embodiments are formed on the belt, and deviation in the left and right direction of the belt is corrected. Further, the present invention includes the case where the optical sensors 24 and 26 detect position information in the left and right direction in addition to the position information in a conveying direction of the marks 96 and 98.

Effects of the Invention

According to aspects of the present invention, the accuracy of the correction processing in an image forming apparatus can be improved.

For example, according to an aspect of the present invention, if one of the first batch and the second batch has been determined to be abnormal, the detection values obtained from the abnormal batch are modified by using the detection values obtained from the other batch. The present invention corrects the image formation position of a formation unit by using the modified detection values. Accordingly, even if one of the pair of batches has been determined to be abnormal, it is possible to perform the correction processing by using the detection values obtained from the other batch. The number of the detection values that can be used for the correction processing increase, and the accuracy of the correction processing can be improved.

Further, according to another aspect of the present invention, it is possible to exactly determine whether a batch is normal or not, by comparing the number of the detection values detected from each batch and a logical value.

Further, according to another aspect of the present invention, the detection values are decided to be modified by using the position information of the detection values obtained from the other batch. Accordingly, it is possible to exactly specify which of the plurality of detection values obtained from one of a pair of batches is to be modified.

Further, according to another aspect of the present invention, the modification processing is performed based on one of a pair of batches which has been determined to be normal, so that the detection values obtained from the other batch, which has been determined to be abnormal, can be exactly corrected.

Further, according to another aspect of the present invention, even in the case where a detection unit detects noises and the like, and the number of the detection values of marks belonging to one of a pair of batches is larger than a logical value, it is possible to delete the detection values caused by noises and the like, so as to make the number of the detection values of the marks belonging to the batch equal to the logical value.

Further, according to another aspect of the present invention, even if the detection unit could not detect marks due to a certain reason, and the number of the detection values of marks belonging to one of a pair of batches is smaller than a logical value, it is possible to add the detection values of the marks that could not have been detected, so as to make the number of the detection values of the marks belonging to the batch equal to the logical value.

Further, according to another aspect of the present invention, where the marks belonging to the first batch and the marks belonging to the second batch are arranged in a same order with equal intervals in the first direction, when comparing the position information of the detection values of marks belonging to one batch and position information of marks belonging to the other batch, the detection values detected from corresponding marks can be easily identified, so that comparison processing can be easily performed.

Further, according to another aspect of the present invention, by the corresponding marks of the first batch and the second batch being disposed at an identical position in the first direction, the position relation of detection values of the corresponding marks does not vary due to movement irregularity. Accordingly, influence of movement irregularity of an object is prevented, and the accuracy of the correction processing by the correction unit can be improved.

Further, according to another aspect of the present invention, by the corresponding marks of the first batch and the second batch being disposed at different positions in the first direction, both the corresponding marks of the first batch and the second batch being scratched due to the scratch growing in the direction perpendicular to the movement direction of the object, so that the detection of the detection values of both the marks can not be performed, is prevented. Accordingly, it is possible to modify detection values of the marks belonging to one batch based on the detection values of the marks belonging to the other batch.

Further, according to another aspect of the present invention, when corresponding marks are detected, positions of the other marks can be predicted based on the results from comparison of position information of each of the marks. Accordingly, specifying the detection values corresponding to each of the marks can be easily performed.

According to another aspect of the present invention, by counting the number of batch groups, in which at least one of a pair of batches has been determined to be abnormal, when the detection values of certain marks belonging to a certain batch have been consecutively determined to be abnormal due to a certain reason, it may be noticed.

Each of the technical elements described in this specification or the drawings has technical utility as a sole or various combinations thereof, and are not limited to combinations defined in the claims at the time of the filing of the application. Further, the technology exemplarily described in this specification or the drawings can simultaneously achieve a plurality of objects, and technical utility can be obtained when one of the plurality of objects is achieved.

What is claimed is:

1. An image forming apparatus comprising:

a formation unit configured to form an image on a relatively moving object which moves in a first direction;

a control unit configured to control the formation unit to form a first batch and a second batch which are disposed at different positions in a second direction perpendicular to the first direction, wherein the first batch includes a plurality of marks arranged in the first direction, and wherein the second batch includes a plurality of marks corresponding to each of the plurality of marks of the first batch, which are respectively arranged in a predetermined position relation in the first direction;

a detection unit configured to detect detection values for the marks belonging to the first batch and the second batch, in relation with position information of the respective marks in the first direction;

a determination unit configured to determine whether each of the first and second batches are normal or abnormal based on the detection values;

a modification unit configured to modify the detection value of a mark belonging to one of the first and second batches that has been determined to be abnormal by the determination unit, based on the detection value of a corresponding mark which belongs to an other of the first and second batches;

a correction unit configured to correct an image forming position of the formation unit based on the detection values modified by the modification unit; and a count unit configured to count a number of the detection values for each of the first and second batches, wherein the determination unit is configured to store a predetermined value, and wherein if the number of the detection values of a batch is equal to the predetermined value, the determination unit determines that the batch is normal, and if the number of the detection values of a batch is not equal to the predetermined value, the determination unit determines that the batch is abnormal.

2. The image forming apparatus claimed in claim 1, wherein the modification unit is configured to compare the position information corresponding to the detection values of the marks belonging to one batch which has been determined to be abnormal, with the position information corresponding to the detection values of the marks belonging to the other batch, and modifies the detection value detected from the mark belonging to the one batch and having position information that does not correspond to the position information of the detection values of the marks belonging to the other batch.

3. The image forming apparatus claimed in claim 2, wherein the control unit is configured to control the formation unit so that the marks belonging to the first batch and the marks belonging to the second batch are arranged in a same order with equal intervals in the first direction.

4. The image forming apparatus claimed in claim 3, wherein the control unit is configured to control the formation unit so that the corresponding marks of the first batch and the second batch are disposed at an identical position in the first direction.

5. The image forming apparatus claimed in claim 1, wherein the modification unit performs the modification processing when the determination unit determines that one batch is abnormal and an other batch is normal.

6. The image forming apparatus claimed in claim 5, wherein the modification unit deletes at least a portion of the detection values of the one batch based on the detection values of the other batch if the number of the detection values of the one batch is larger than a predetermined value.

7. The image forming apparatus claimed in claim 5, wherein the modification unit adds at least a portion to the detection values of the one batch based on the detection values of the other batch if the number of the detection values of the one batch is smaller than a predetermined value.

8. The image forming apparatus claimed in claim 1, wherein the control unit is configured to control the formation unit so that the corresponding marks of the first batch and the second batch are disposed at different positions in the first direction.

9. The image forming apparatus claimed in claim 1, wherein the modification unit is configured to detect at least a pair of corresponding marks from the detection values of the first batch and the detection values of the second batch, and predicts a position of one of the pair of corresponding marks based on the position information of the other of the pair of corresponding marks.

10. The image forming apparatus claimed in claim 1, wherein the control unit is configured to control the formation unit so that a group of batches, including the first batch and the second batch, are formed in plural, and the determination unit is configured to count a number of the groups of batches in which at least one of the batches has been determined to be abnormal, and if the number exceeds a reference value, the determination unit either informs a user or discards the detection value.

11. A computer readable storing medium storing a computer program for causing an image forming apparatus to perform a method of:

forming an image on a relatively moving object which moves in a first direction;

controlling the formation unit to form a first batch and a second batch which are disposed at different positions in a second direction perpendicular to the first direction, wherein the first batch includes a plurality of marks arranged in the first direction, and wherein the second batch includes a plurality of marks corresponding to each of the plurality of marks of the first batch, which are respectively arranged in a predetermined position relation in the first direction;

detecting detection values for the marks belonging to the first batch and the second batch, in relation with position information of the respective marks in the first direction;

determining whether each of the first and second batches are normal or abnormal based on the detection values;

modifying the detection value of a mark belonging to one of the first and second batches that has been determined to be abnormal by the determination unit, based on the detection value of a corresponding mark which belongs to an other of the first and second batches;

correcting an image forming position of the formation unit based on the detection values modified by the modification unit; and counting a number of the detection values for each of the first and second batches, wherein the step of determining whether each of the first and second batches are normal or abnormal further includes storing a predetermined value, and wherein the batch is determined to be normal if the number of the detection values of a batch is equal to the predetermined value, and the batch is determined to be abnormal if the number of the detection values of a batch is not equal to the predetermined value.

12. An image forming apparatus comprising:

a formation unit configured to form an image on a relatively moving object which moves in a first direction;

a control unit configured to control the formation unit to form a first batch and a second batch which are disposed at different positions in a second direction perpendicular to the first direction, wherein the first batch includes a plurality of marks arranged in the first direction, and wherein the second batch includes a plurality of marks corresponding to each of the plurality of marks of the first batch, which are respectively arranged in a predetermined position relation in the first direction;

a detection unit configured to detect detection values for the marks belonging to the first batch and the second batch, in relation with position information of the respective marks in the first direction;

a determination unit configured to determine whether each of the first and second batches are normal or abnormal based on the detection values;

a modification unit configured to modify the detection value of a mark belonging to one of the first and second batches that has been determined to be abnormal by the determination unit, based on the detection value of a corresponding mark which belongs to an other of the first and second batches; and a correction unit configured to correct an image forming position of the formation unit based on the detection values modified by the modification unit, wherein the modification unit performs the modification processing when the determination unit determines that one batch is abnormal and an other batch is normal.

13. The image forming apparatus claimed in claim 12, wherein the modification unit is configured to compare the position information corresponding to the detection values of the marks belonging to one batch which has been determined to be abnormal, with the position information corresponding to the detection values of the marks belonging to the other batch, and modifies the detection value detected from the mark belonging to the one batch and having position information that does not correspond to the position information of the detection values of the marks belonging to the other batch.

14. The image forming apparatus claimed in claim 13, wherein the control unit is configured to control the formation unit so that the marks belonging to the first batch and the marks belonging to the second batch are arranged in a same order with equal intervals in the first direction.

15. The image forming apparatus claimed in claim 14, wherein the control unit is configured to control the formation unit so that the corresponding marks of the first batch and the second batch are disposed at an identical position in the first direction.

16. The image forming apparatus claimed in claim 12, wherein the modification unit deletes at least a portion of the detection values of the one batch based on the detection values of the other batch if the number of the detection values of the one batch is larger than a predetermined value.

17. The image forming apparatus claimed in claim 12, wherein the modification unit adds at least a portion to the detection values of the one batch based on the detection values of the other batch if the number of the detection values of the one batch is smaller than a predetermined value.

18. The image forming apparatus claimed in claim 12, wherein the control unit is configured to control the formation unit so that the corresponding marks of the first batch and the second batch are disposed at different positions in the first direction.

19. The image forming apparatus claimed in claim 12, wherein the modification unit is configured to detect at least a pair of corresponding marks from the detection values of the first batch and the detection values of the second batch, and predicts a position of one of the pair of corresponding mark based on the position information of the other of the pair of corresponding mark.

20. The image forming apparatus claimed in claim 12, wherein the control unit is configured to control the formation unit so that a group of batches, including the first batch and the second batch, are formed in plural, and the determination unit is configured to count a number of the groups of batches in which at least one of the batches has been determined to be abnormal, and if the number exceeds a reference value, the determination unit either informs a user or discards the detection value.

* * * * *